US006491363B1

(12) United States Patent
Masutani et al.

(10) Patent No.: US 6,491,363 B1
(45) Date of Patent: Dec. 10, 2002

(54) RECORDING DEVICE

(75) Inventors: Takeshi Masutani, Osaka (JP); Kazuhiko Fujikawa, Kyoto (JP); Koji Nomura, Nara (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/889,257

(22) PCT Filed: Nov. 15, 2000

(86) PCT No.: PCT/JP00/08037

§ 371 (c)(1),
(2), (4) Date: Oct. 22, 2001

(87) PCT Pub. No.: WO01/36201

PCT Pub. Date: May 25, 2001

(30) Foreign Application Priority Data

Nov. 16, 1999 (JP) ..... 11-325095

(51) Int. Cl.[7] ..... B41J 29/393
(52) U.S. Cl. ..... 347/19
(58) Field of Search ..... 347/19, 14, 23, 347/52, 7, 6

(56) References Cited

U.S. PATENT DOCUMENTS 5,430,306 A * 7/1995 Ix ..... 347/6
5,510,820 A * 4/1996 Aulick et al. ..... 347/85

FOREIGN PATENT DOCUMENTS

JP 6-191047 7/1994
JP 6-229821 8/1994

OTHER PUBLICATIONS

International Search Report corresponding to application No. PCT/JP00/08037 dated Feb. 20, 2001.
English translation of Form PCT/ISA/210.

* cited by examiner

*Primary Examiner*—Raquel Yvette Gordon
*Assistant Examiner*—Charles W. Stewart, Jr.
(74) *Attorney, Agent, or Firm*—RatnerPrestia

(57) ABSTRACT

A recording device capable of accurately detecting the presence and absence of ink particles ejected from plural ejecting outlets aligned in a lateral direction of a head thereof. In the recording device, the sensing field of an infrared sensor is directed toward flying ink particles but directed toward landed particles. Whereby the thermal energy from the landing ink particles remarkably increases a thermal energy applied to infrared sensor.

12 Claims, 4 Drawing Sheets

RECORDING DEVICE

FIELD OF THE INVENTION

The present invention relates to a recording device for ejecting an ink particle from an ejecting outlet of a head.

BACKGROUND OF THE INVENTION

A conventional recording device includes a head having an array of ejecting outlets aligned laterally and an ejecting sensor for detecting that an ink particle is ejected downwardly from the outlets of the head. The ejecting sensor detects a thermal energy radiated from the flying ink particles.

The conventional recording device hardly detects accurately the presence and absence of the ink particles with an infrared sensor. Since flying very fast, the ink particles ejected from the ejecting outlets passes across a sensing field of the infrared sensor for a short time, thus providing the sensor with a small thermal energy. Continuously ejecting the ink particles increases a consumption of ink.

SUMMARY OF THE INVENTION

A recording device capable of detecting accurately the presence and absence of an ink particle is provided, in which an infrared sensor receives a much thermal energy from the ink particle.

The recording device has a sensing field of the infrared sensor not directed toward a flying ink particle but directed toward a landing ink particle. The steady ink particle enables the infrared sensor to receive an increasing thermal energy, so that the sensor may detects accurately the presence and absence of the particle.

DESCRIPTION OF THE PREFERRED EMBODIMENT

Exemplary Embodiment 1

Figure 1:
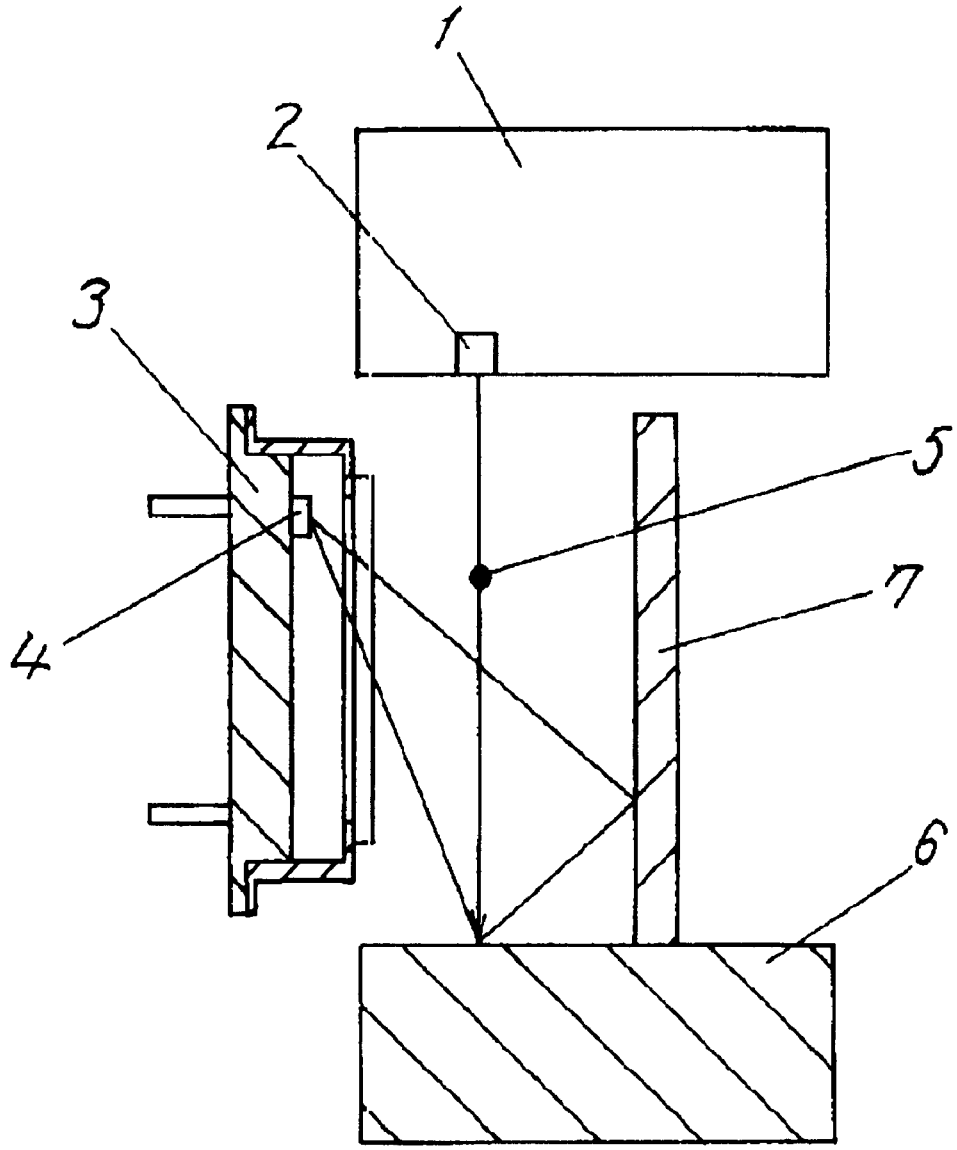
FIG. 1 is a cross sectional view of a recording device according to exemplary embodiment 1 of the present invention.
Figure 2:
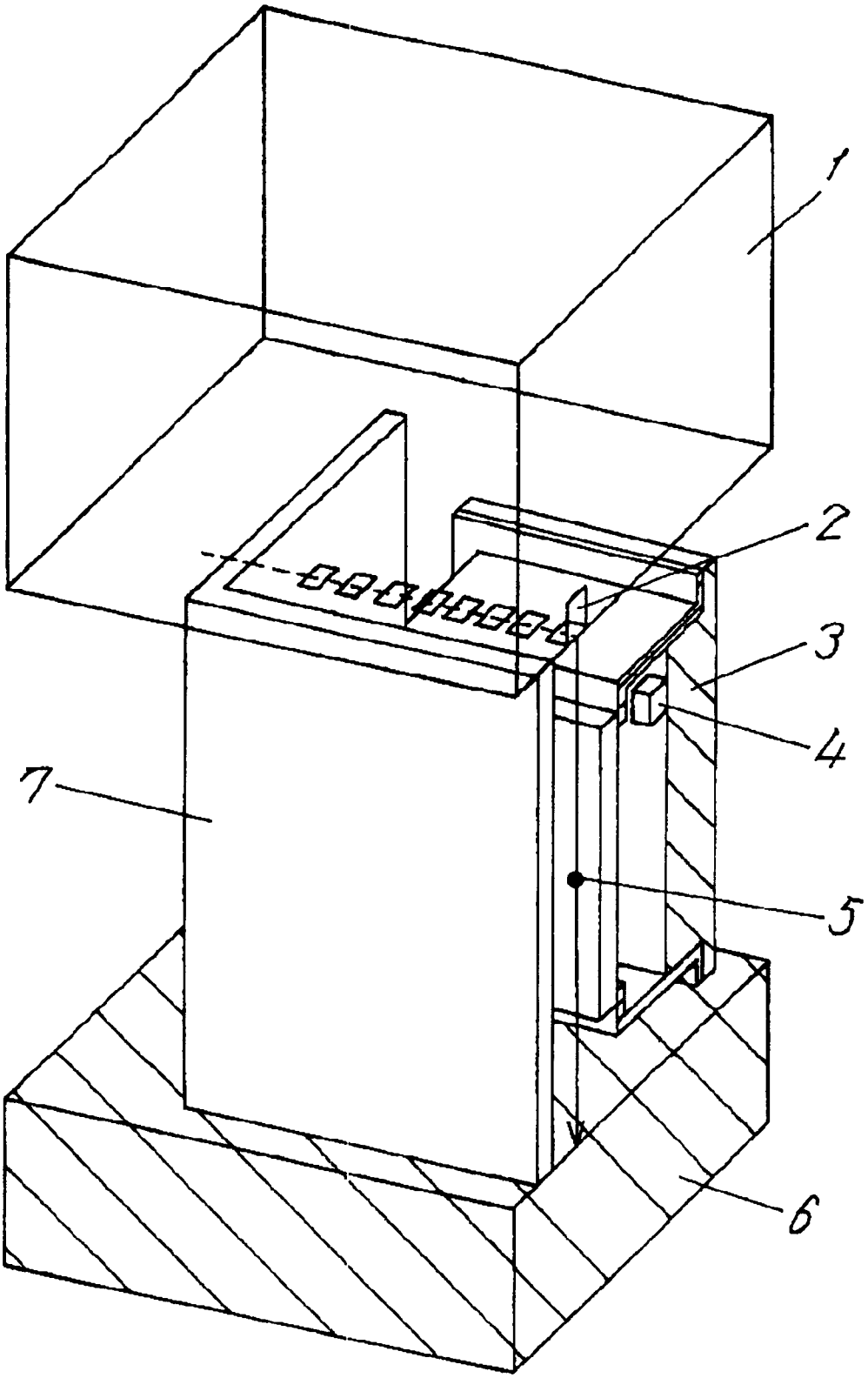
FIG. 2 is a perspective cutout view of the recording device according to embodiment 1 of the invention.

FIG. 1 is a cross sectional view of a recording device according to exemplary embodiment 1 of the present invention, and FIG. 2 is a perspective cutout view of the device. A head 1 has one hundred twenty eight ejecting outlets 2 provided in the bottom thereof aligned laterally at equal intervals. The head 1 slides leftward and rightward in FIG. 1 (not shown) and ejects ink particles ink toward a recording medium such as a sheet of paper placed at a specified position. FIG. 1 illustrates a state before and after the recording operation. In FIG. 1, prior to a recording operation, it is examined whether or not an ink particle is ejected from each of the ejecting outlets 2. If failing to eject the ink particle from at least one of the outlets 2, the head 1 does not print the recording medium accurately. For the examination, the device has an infrared sensor 3 having a photo element 4 for detecting an ejected ink particle.

An ink particle 5 ejected from the outlet 2 flies downwardly substantially at a right angle against the bottom of the head 1 and lands on a pad 6. The infrared sensor 3 senses over he sensing field covering an intermediate way and the landing point of the flying ink particle. As the ink particle 5 receives a heat from the head 1 when being ejected and thus being at a higher temperature than the ambient one, the infrared sensor easily detects a change of a thermal energy. The sensor 3 detects it in the field covering the landing point of the ink particle 5, which is essential, and thus outputting sufficiently If having a sensing field directed toward only the flying particle 5, the infrared sensor 3 receives a little thermal energy from the ink particle 5 passing the field in a very short time. Contrary to this, if having a sensing field directed toward the landing ink particle 5, the sensor 3 receives a much increasing thermal energy from the steady ink particle 5 and thus detects the ink particle 5.

It is also essential to select the material of the pad 6. The recording device usually has the pad made of felt for absorbing excess ink. The pad 6 shown in FIG. 1 is preferably made of the same felt. The felt, for being made of fiber, has a low thermal conductivity, i.e., high heat-retention and thus dispossesses slowly a heat from the landing ink particles 5. This allows the infrared sensor 3 to continuously receive a more thermal energy from the ink particle. If being made of thermally conductive material such as metal, the pad 6 can quickly deprive the heat of the ink particles 5 hence declining the effect of the landing.

It is also essential that the sensing field of the infrared sensor 3 does not cover the ejecting outlets 2 and their neighbor area. In general, the ejecting outlets 2 and their neighbor area are significantly hot while ejecting the ink particle 5. This may be emphasized while the ejecting outlets 2 are clogged with ink. Such an increase of a temperature may cause the infrared sensor 3 to release an exaggerated output. Consequently, the location of the sensing field is crucial.

A reflector 7 reflects the thermal energy radiated from the ink particle and make the infrared sensor 3 efficiently receive it. The reflector 7 may be a metal plate having a smooth surface. The thermal energy or infrared ray radiated from the ink particle 5 landing on the pad 6 is received by the photo element 4 directly and after reflected on the reflecting plate 7. The reflecting plate 7 enlarges the effectiveness of the infrared sensor 3 about 50% as comparing with no use of the reflecting plate 7.

Embodiment 2

Figure 3:
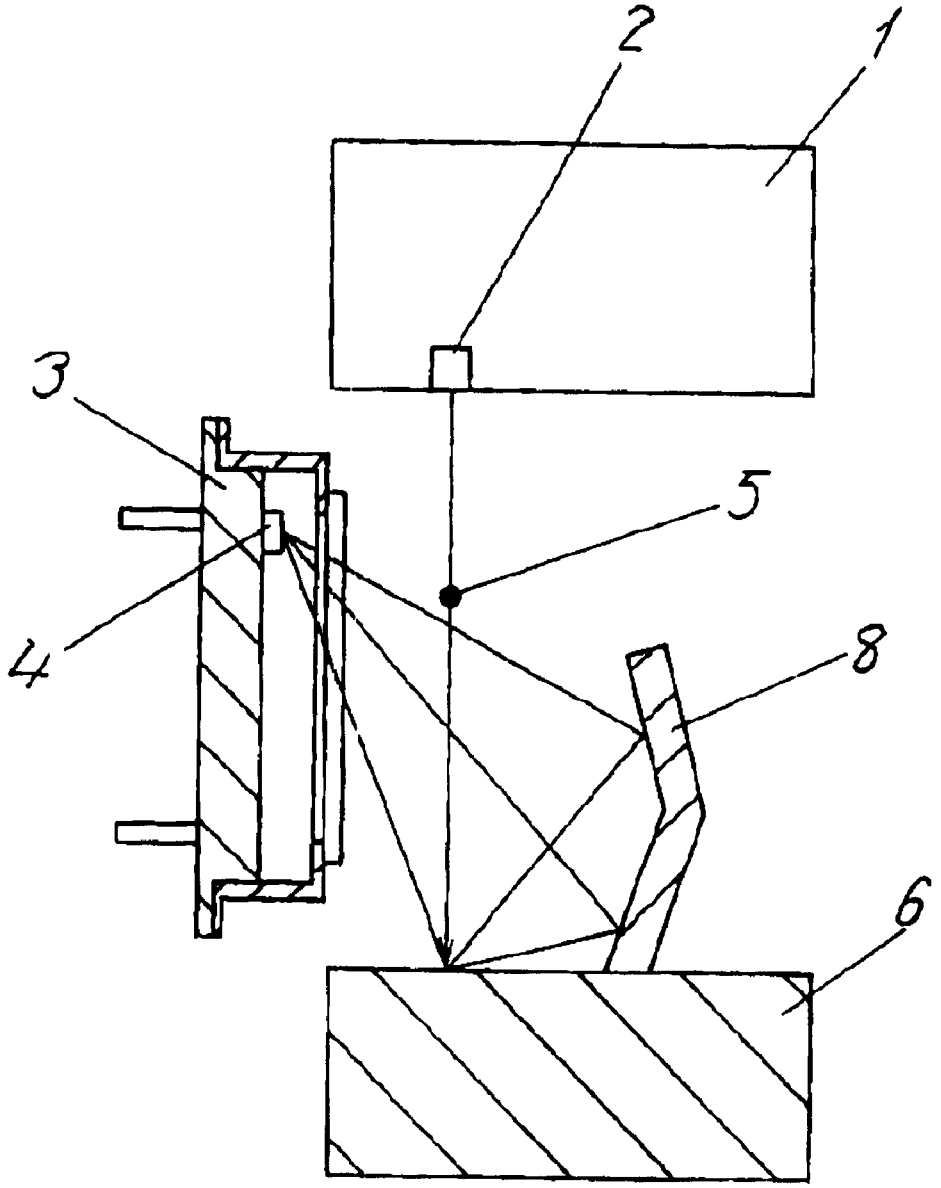
FIG. 3 is a cross sectional view of a recording device according to exemplary embodiment 2 of the invention.

FIG. 3 is a cross sectional view of a recording device according to exemplary embodiment 2 of the present invention. The recording device according to this embodiment includes a multi-surface reflector 8 instead of the reflector 7 in embodiment 1. The multi-surface reflector 8 reflects an infrared ray at different angles with multiple surfaces along multiple paths to the infrared sensor 3 and enables a thermal energy radiated from the ink particle 5 to be transferred effectively to the infrared sensor 3. The multiple reflecting surfaces contribute to the increase of the effectiveness of the infrared sensor 3 while the effect of the reflector may be limited according to an variation of a flying route and landing point of the ink particle 5.

Exemplary Embodiment 3

Figure 4:
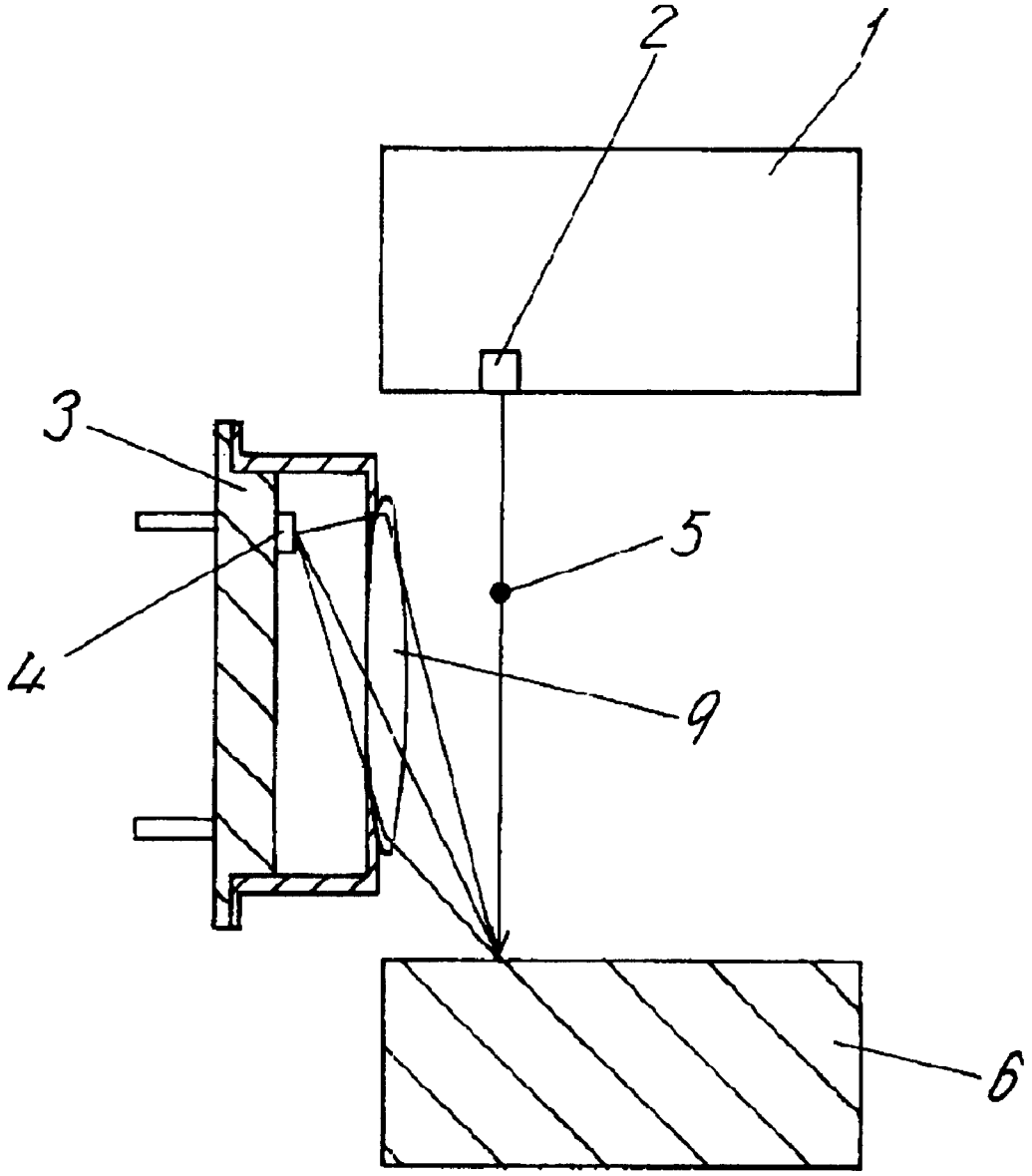
FIG. 4 is a cross sectional view of a recording device according to exemplary embodiment 3 of the invention.

FIG. 4 illustrates a cross section of a recording device according to exemplary embodiment 3 of the present invention. The device particularly includes a lens 9 instead of the reflector 7 in embodiment 1. This transfers a thermal energy radiated from the ink particle 5 more efficiently to an infrared sensor 3. Infrared ray radiated from the ink particle 5 landing on the pad 6 is converged by the lens 9 and projected on the photo element 4. Therefore, the effectiveness of the infrared sensor 3 can be increased without the reflector 7.

INDUSTRIAL APPLICABILITY

The present invention relates to a recording device in which ejecting outlets of a head eject ink particles. The device is capable of detecting the presence and absence of the ink particles. The sensing field of an infrared sensor covers does not direct toward flying ink particles but toward to particles landing on an object to be printed. An increased thermal energy from the landing, steady ink particles is effectively received by the infrared sensor, and thus enables the presence and absence of the ink particles to be detected accurately.

What is claimed is:

1. A recording device comprising:

a head having an ejecting outlet ejecting an ink particle to a recording medium; and an infrared sensor for detecting the ink particle ejected from said ejecting outlet, said infrared sensor having a sensing field covering a landing point of the ink particle.

2. The recording device according to claim 1, further comprising an ink absorbing member disposed at the landing point.

3. The recording device according to claim 2, wherein said ink absorbing member is made of felt.

4. The recording device according to claim 1, wherein the sensing field of said infrared sensor covers neither said ejecting outlet nor a neighbor area of said ejecting outlet.

5. A recording device comprising:

a head having an ejecting outlet ejecting an ink particle to a recording medium;

an infrared sensor for detecting the ink particle ejected from said ejecting outlet, said infrared sensor having a sensing field covering a landing point of the ink particle; and a reflector disposed near the landing point, said reflector reflecting a infrared ray radiated from the ink particle toward said infrared sensor.

6. The recording device according to claim 5, further comprising an ink absorbing member disposed at the landing point.

7. The recording device according to claim 6, wherein said ink absorbing member is made of felt.

8. The recording device according to claim 5, wherein the sensing field of said infrared sensor covers neither said ejecting outlet nor a neighbor area of said ejecting outlet.

9. A recording device comprising:

a head having an ejecting outlet ejecting an ink particle to a recording medium;

an infrared sensor for detecting the ink particle ejected from said ejecting outlet, said infrared sensor having a sensing field covering a landing point of the ink particle; and a lens disposed at said infrared sensor, said lens having a viewing field covering the landing point.

10. The recording device according to claim 9, further comprising an ink absorbing member disposed at the landing point.

11. The recording device according to claim 10, wherein the ink absorbing member is made of felt.

12. The recording device according to claim 9, wherein the sensing field of the infrared sensor covers neither said ejecting outlet nor a neighbor area of said ejecting outlet.

* * * * *